US006347687B1

(12) United States Patent
Alim

(10) Patent No.: US 6,347,687 B1
(45) Date of Patent: Feb. 19, 2002

(54) COMPACT COLLAPSIBLE STEP LADDER

(75) Inventor: Prakasa Alim, Surabaya (ID)

(73) Assignee: PT Indal Aluminum Industry TBK., Gedangan (ID)

( * ) Notice: Subject to any disclaimer, the term of this patent is extended or adjusted under 35 U.S.C. 154(b) by 0 days.

(21) Appl. No.: 09/398,124

(22) Filed: Sep. 16, 1999

(51) Int. Cl.[7] ..... E06C 1/00
(52) U.S. Cl. ..... 182/161; 182/159
(58) Field of Search ..... 182/156, 159, 182/161, 163, 165, 228.1, 228.6; 403/102, 119; 16/335, 355; D25/64

(56) References Cited

U.S. PATENT DOCUMENTS

| | | | | |
|---|---|---|---|---|
| 421,914 | A | * 2/1890 | Dormitzer | 182/116.1 |
| 1,806,502 | A | * 5/1931 | Rosenberg | 182/161 |
| 3,303,906 | A | * 2/1967 | Bouwmeester et al. | 182/161 |
| 4,485,892 | A | * 12/1984 | Maloney et al. | 182/161 |
| 4,718,518 | A | 1/1988 | Brown | |
| 4,754,845 | A | 7/1988 | Baker | |
| 4,796,727 | A | 1/1989 | Eaton | |
| D300,365 | S | 3/1989 | Wallick, Jr. et al. | |
| 4,974,701 | A | 12/1990 | Parise | |
| 5,060,755 | A | 10/1991 | Bourdages et al. | |
| 5,158,151 | A | 10/1992 | Chang | |
| 5,195,610 | A | 3/1993 | Chang | |
| D343,906 | S | 2/1994 | Murray | |
| D351,476 | S | 10/1994 | Grosfillex | |
| 5,503,245 | A | 4/1996 | Etesam | |
| D392,744 | S | 3/1998 | Staal | |
| D397,228 | S | 8/1998 | Bell et al. | |
| D401,353 | S | 11/1998 | Bell et al. | |
| D414,879 | S | 10/1999 | Meyers | |
| 5,967,260 | A | 10/1999 | Spak | |
| D416,092 | S | 11/1999 | Meyers | |

FOREIGN PATENT DOCUMENTS

| | | | | |
|---|---|---|---|---|
| GB | 2081793 | * | 2/1982 | 182/165 |
| IT | 65492 | * | 2/1982 | 182/161 |

* cited by examiner

*Primary Examiner*—Daniel P. Stodola
*Assistant Examiner*—Hugh B. Thompson
(74) *Attorney, Agent, or Firm*—Banner & Witcoff, Ltd.

(57) ABSTRACT

A novel compact collapsible step ladder that can be efficiently, easily and practically stored in space limited locations or areas when not in use. The compact collapsible step ladder when folded, and not in use, is no thicker that the combined thickness of its adjacent and substantially parallel front and rear ladder legs. The collapsible step ladder comprises a pair of pivotally connected ladder legs, a pivoting step with rear opposing pegs engaging rear ladder channel guides, and at least one ladder pivoting rung connected to the step through connecting rods. The connecting rods synchronize the movement of the pivoting step and the at least one pivoting rung as the ladder assumes the open and closed positions. In the ladder open position, the step and at least one ladder rung assume substantially horizontal orientations. In the ladder closed position the step and the at least one ladder rung are substantially parallel to the ladder legs.

23 Claims, 9 Drawing Sheets

4
24
17
16
37
36
9
13
29
33
19
28
39
20
34
14
40
44
79
64
71
48
68
76
72
91
56
87
61
60
120
84
80
8
92
32
88
106
93
96
100
12
124
29A
105
89
108
112
27
128B
33A
9A
128D
128A
31
7
13A
128C
1
11

FIG. 4A
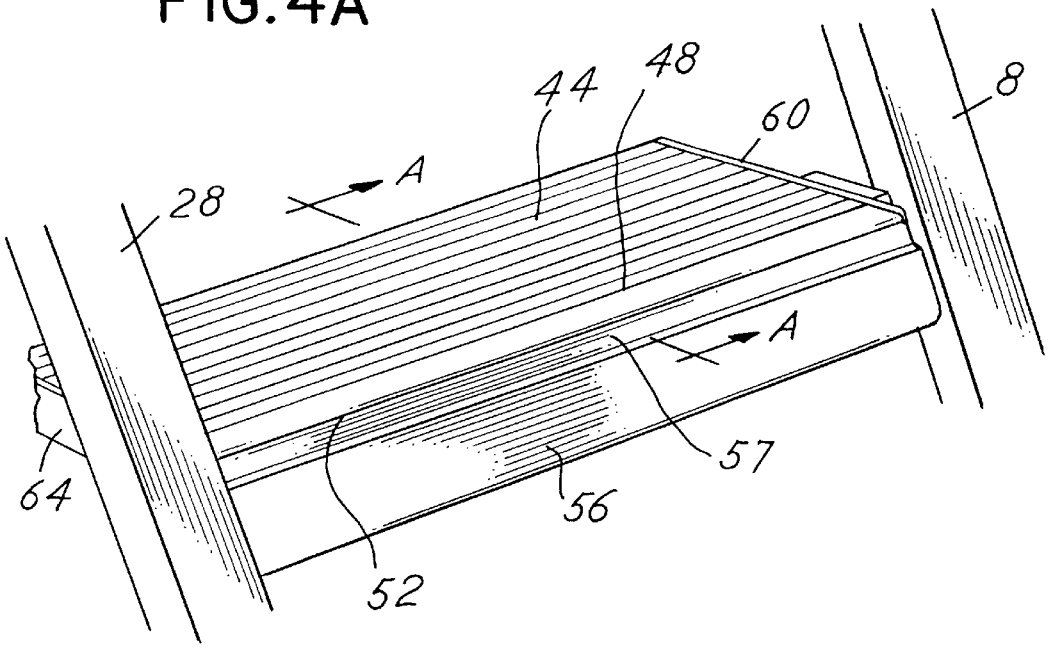
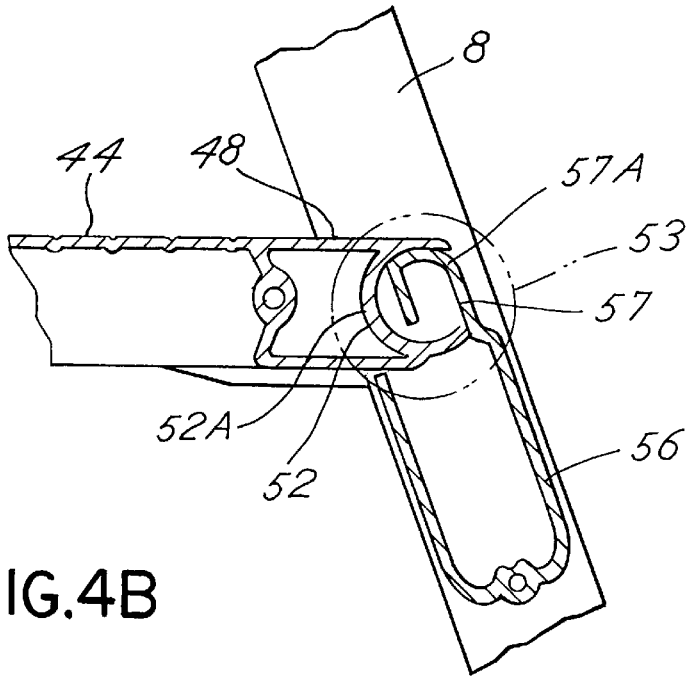
FIG. 4B

FIG.4C
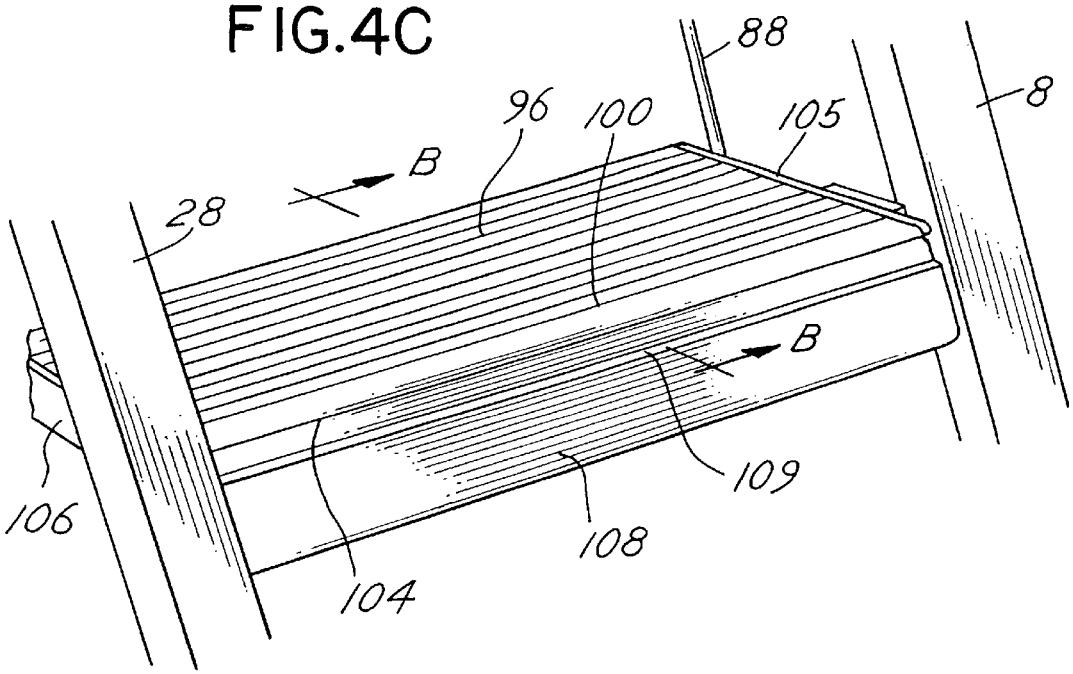
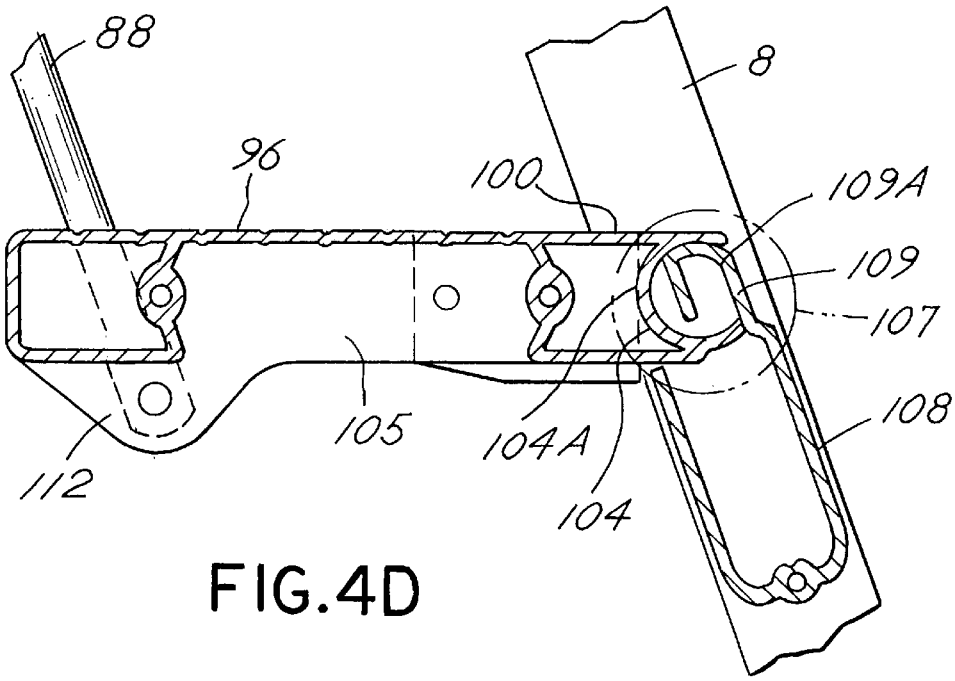
FIG.4D 16
14
20
52
48
44
68
53
80
57
84
56
61
60
120
8
45
12
88
100
96
104
107
112
109
108
124
95
128A
128C

COMPACT COLLAPSIBLE STEP LADDER

BACKGROUND OF THE INVENTION

This invention relates to collapsible step or utility ladders, and more particularly to a collapsible step ladder that is compact and that requires minimal storage space.

A drawback of existing step ladders is that they are typically bulky and consequently require large storage spaces or separate storage facilities. The size and configuration of existing collapsible step ladders is not as important in places where storage is readily available, such as work sites, warehouses, factories, etc. However, in some instances storage facilities may be limited by the physical construction of those facilities or by the costs of maintaining large storage facilities.

Additionally, storage space is even more at a premium in typical city living units, such as condominiums and apartments, or in college dormitory rooms. Moreover, a user may want to use other areas as storage space, for example the trunk of a car, a small closet, kitchen, hamper, underneath a bed or sofa, etc., but is limited by the configuration of existing collapsible step ladders. Existing collapsible step ladders are typically large and bulky and do not allow such uses. For the foregoing reasons, there is a need for a simple collapsible step ladder that is slim and compact that can be efficiently, easily and practically stored in space starved locations, such as a person's apartment, condominium or dormitory room or small storage areas, when not in use.

SUMMARY OF THE INVENTION

Briefly, the present invention is a compact collapsible step ladder assembly that is comprised of a novel configuration of components such that the overall closed ladder thickness or overall dimension of the collapsed ladder does not exceed the combined thickness of the front and rear ladder legs. The compact collapsible step ladder addresses the need for a step ladder design with minimal storage space requirements. The new compact collapsible step ladder is durable, convenient and may be stored in a myriad of space limited areas.

In the preferred embodiment of the present invention, the compact collapsible step ladder assembly operates between an open position and a closed position. The step ladder comprises a first and second ladder support, a step, at least one rung and at least one connecting member. The first ladder support comprises a first front and a first rear leg with the first front and first rear legs being pivotally connected and each having a predetermined thickness. Further, the first front and first rear legs form an acute angle in the ladder open position and are substantially parallel to each other in the ladder closed position. Moreover, the first rear ladder leg further comprise a first channel guide and a first guide stopper. The second ladder support comprises a second front and a second rear leg with the second front and second rear legs being pivotally connected and each having a predetermined thickness. The second front and second rear legs also form an acute angle in the ladder open position and are substantially parallel to each other in the ladder closed position. The second rear ladder leg further comprises a second channel guide and a second guide stopper. The step ladder has a step that is adapted for pivotal movement with respect to the front ladder legs. The step further has a rear step portion, a first side step portion with a first step connector, a second side step portion with a second step connector. Extending from the step is a first and second peg. The first peg extends from a rear end portion of the step and slidably engages the first channel guide. Further, in the ladder open position, the first peg rests against the first guide stopper to maintain the step in a substantially horizontal orientation. The second peg extends from an opposing rear end portion of the step, the second peg slidably engages the second channel guide. Again, in the ladder open position, the second peg rests against the second guide stopper to maintain the step in a substantially horizontal orientation. The step ladder also has at least one rung. In the preferred embodiment of the invention, there is one rung. In another version of the present invention, the step ladder has two rungs. The ladder rung or rungs are adapted for pivotal movement with respect to the front ladder legs and have a first side rung portion with a first rung connector and a second side rung portion with a second rung connector. The step ladder further has at least one connecting member or connecting rod. In the preferred embodiment, a pair of connecting rods, or connecting members, couple the first step connector to the first rung connector and the second step connector to the second rung connector. The pair of connecting rods synchronize the movement of the ladder rung with the step as the ladder assumes the open and closed positions. In the two rung version of the step ladder, the connecting rods simultaneously couple the step and the two rungs to synchronize their movement. In either the one or two rung versions of the ladder, the compact collapsible ladder, in the closed position, has a collapsed ladder thickness that does not exceed the combined thickness of the front and rear ladder legs.

The embodiments of the invention may additionally include front cross-braces for added support, strength and stability of the ladder. The preferred embodiment of the invention includes a front step portion, a step brace, a front rung portion and a rung brace. The step brace extends between the front legs and cooperatively engages the front step portion for pivotal movement of the step with respect to the first and second front legs. The rung brace extends between the front legs and cooperatively engages the front rung portion for pivotal movement of the rung with respect to the first and second front legs. Additionally, the step ladder may add at least one rear cross-brace between the first and second rear legs for greater support, strength and stability.

In another embodiment of the present invention, a compact collapsible step ladder comprises a front leg pair and a rear leg pair pivotally connected to the front leg pair. The pivotal connection permits movement of the rear leg pair in a collapsing direction from an open position where respective ends of the front and rear leg pairs are disposed in a distal relationship, and where said respective ends are disposed in a proximal relationship in a closed position. The front leg pair has a first maximum thickness measured in the collapsing direction and the rear leg pair has a second maximum thickness measured in the collapsing direction. The step ladder has a step that cooperates with the front leg pair and has a step width that exceeds the first and second maximum thicknesses. The step ladder also has at least one rung that cooperates with the front leg pair and has a rung width that exceeds the first and second maximum thicknesses. The step ladder includes a means for pivoting the step and at least one rung relative to the front leg pair as the rear leg pair is moved from the open position to the closed position. The step ladder, in the closed position, has a maximum overall thickness, measured in the collapsing direction, that is less than the width of the step or at least one rung. Furthermore, the maximum overall thickness of the ladder in the closed position does not substantially exceed the sum of the first and second maximum thickness.

Additionally, the means for pivoting the step and rung may include a step pivot connection between the step and a step brace extending between the front leg pair, and a rung pivot connection between the rung and a rung brace extending between the front leg pair. The step pivot connection also has a brace pivot surface formed on the step brace and a step recess on the step, the step recess being shaped complementarily to the brace pivot surface, and the rung pivot connection also having a rung pivot surface formed on the rung brace and a rung recess on the rung, where the rung recess is shaped complementarily to the rung pivot surface.

An object of the present invention is to provide a compact collapsible step ladder that, when collapsed and not in use, requires minimal storage space.

An object of the present invention is to provide a collapsible step ladder that, when collapsed and not in use, will be completely composed and contained between the ladder legs and can thereby be stored in small areas, e.g., apartment closets, kitchen hampers, underneath furniture, etc.

An object of the present invention is to provide a collapsible step ladder that when folded and not in use is no thicker that the combined thickness of adjacent and substantially parallel front and rear ladder legs.

An object of the present invention is to provide a lightweight aluminum collapsible step ladder that when folded and not in use is no thicker that the combined thickness of adjacent and substantially parallel front and rear ladder legs.

These and other attributes of the invention will become clearer upon a thorough study of the following description of the invention and claims that follow, particularly when reviewed in conjunction with the figures.

BRIEF DESCRIPTION OF THE DRAWING

In the detailed description that follows, references will be made to a drawing comprised of the following figures:

FIG. 4A is a front perspective view showing in more detail a step, front ladder legs and a step brace.

FIG. 4B is a side orthogonal view of the step ladder through a section line A—A showing a step pivotal connection between the step and the step brace.

FIG. 4C is a front perspective view showing in more detail a rung, the front ladder legs and a rung brace.

FIG. 4D is a side orthogonal view of the step ladder through a section line B—B showing a rung pivotal connection between the rung and the rung brace.

DETAILED DESCRIPTION OF THE PREFERRED EMBODIMENT

Figure 1:
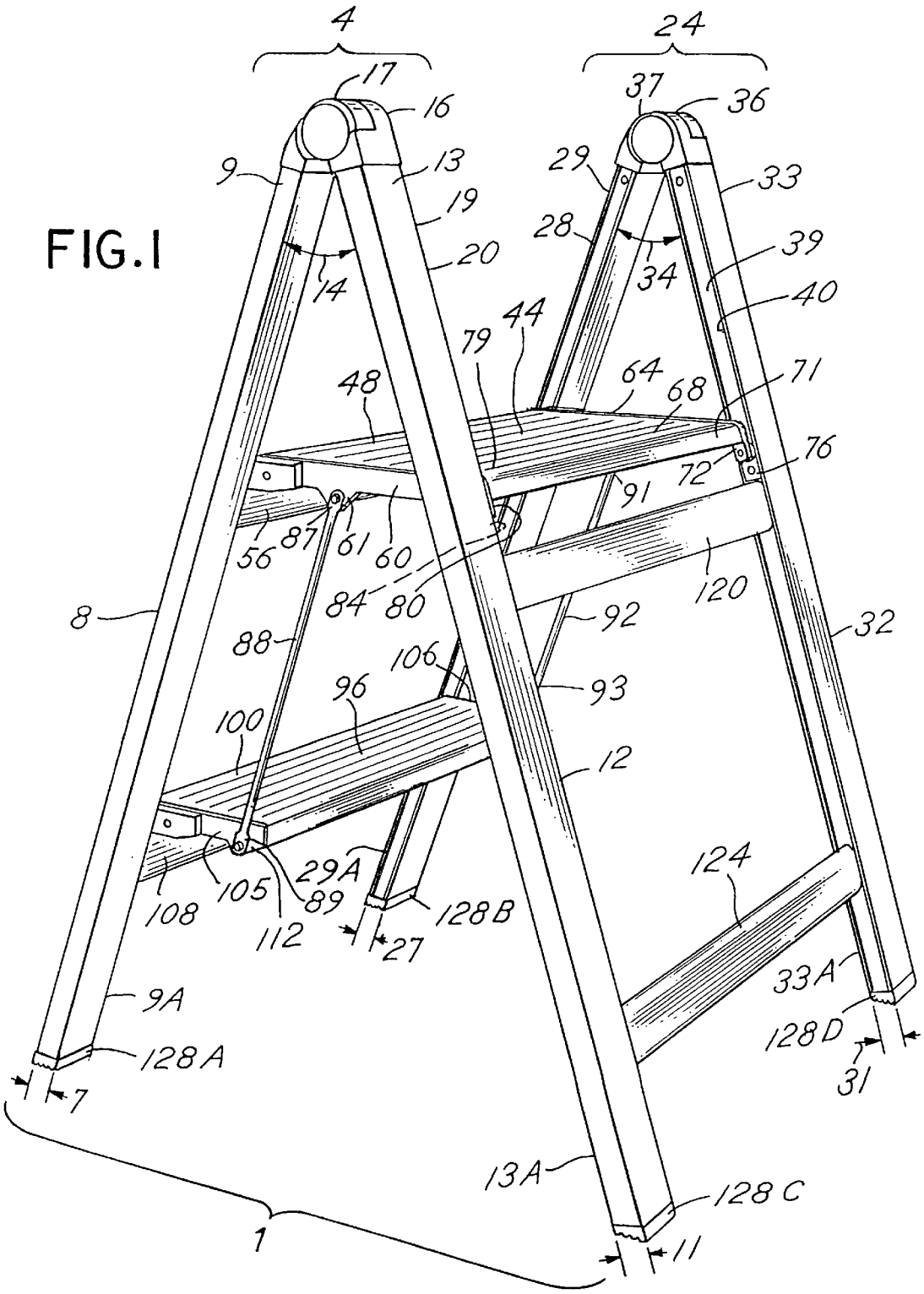
FIG. 1 is an isometric view showing a collapsible step ladder that forms the basis of the preferred embodiment of the present invention in an open position.

FIG. 1 shows an isometric view of the preferred embodiment of the present invention that is a collapsible step ladder 1, that operates between a ladder open position and a ladder closed position. In the preferred embodiment, the collapsible step ladder 1 is comprised generally of a pair of ladder supports 4 and 24, a ladder step 44, at least one ladder rung 96 and connecting rods 88 and 92.

The first ladder support 4 has a first front ladder leg 8 and a first rear ladder leg 12. The first front ladder leg 8 and the first rear ladder leg 12 each have predetermined thicknesses 7 and 11 respectively. The thickness 7 and 11 of the first front leg 8 and the first rear leg 12 are directly related to an overall collapsed ladder thickness 10 (shown and discussed with reference to FIG. 7) that gives the step ladder 1 its compact feature in the closed ladder position. The first front and rear ladder legs 8 and 12 are connected at their top ends 9 and 13 through a pivotal connection 16 that allows the first front and rear ladder legs 8 and 12 to collapse toward one another from the open position and to move away from one another from the closed position. The first rear leg 12 further comprises a first channel guide 20 (not shown) along the inner side 19 (not shown) of the rear ladder leg 12. The inner side 19 of the first rear ladder leg 12 also has a first guide stopper 84 disposed in the first channel guide 20. In the open position shown in FIG. 1, the first ladder support 4 takes on the form of an inverted V. In the preferred embodiment, illustrated in FIG. 1, the pivotal connection 16 is comprised of a hinge type mechanism 17. However, the ladder legs 8 and 12 may be connected in any manner that will allow the first front and first rear ladder legs to move towards and away from each other. Further, in the preferred embodiment of this invention, the first front and rear ladder legs 8 and 12 form an acute angle 14 in the ladder open position (also shown in FIG. 5).

In the preferred embodiment, the second ladder support 24 is identical to the first ladder support 4. The second ladder support 24 has a second front ladder leg 28 and a second rear ladder leg 32, each having a predetermined thickness 27 and 31 respectively. Again, as was the case with the first front and first rear legs 8 and 12, the thickness 27 and 31 of the second front leg 28 and the second rear leg 32 are directly related to the overall collapsed ladder thickness 10 (shown and discussed with reference to FIG. 7) that gives the step ladder 1 its compact feature in the closed ladder position. The second front and rear ladder legs 28 and 32 are connected at their top ends 29 and 33 through a pivotal connection 36 that also allows the second front and rear ladder legs 28 and 32 to collapse toward one another from the open position. The second rear leg 32 further comprises a second channel guide 40 (more clearly shown in FIGS. 2 & 3) along the inner side 39 of the second rear ladder leg 32. Though not clearly shown, the first guide channel 20 has an identical configuration as guide channel 40 (more clearly shown in FIGS. 2 & 3). The inner side 39 of the rear ladder leg 32 also has a second guide stopper 76 disposed in the second channel guide 40. In the open position the second ladder support 24 takes on the form of an inverted V. As in the first ladder support 4, the pivotal connection 36 is a hinge type mechanism 37 but can be connected in any manner that will allow the second front and rear ladder legs 28 and 32 to move towards and away from each other. Further, in the preferred embodiment, the second front and rear legs 28 and 32 form an acute angle 34 in the ladder open position.

The step ladder 1 further includes a step 44. The step 44 may be described by various sections and is disposed between the four ladder legs 8, 12, 28 and 32. The step 44 has a front step portion 48, a first side portion 60 with a step connector 61 and an opposing second side portion 64 with an opposing second step connector 65. The step 44 also has a rear step portion 68 with a first peg 80 extending form the rear step portion end 79 and an opposing second peg 72 extending from the opposing rear step portion end 71. In the preferred embodiment, the first and second pegs 80 and 72 extend downward and outward relative to the step 44. Additionally, in the preferred embodiment, the step 44 has a front step portion 48 that has a step recess portion 52 (shown in FIGS. 4A & 4B). The step recess portion 52 extends longitudinally across the front step portion 48 of the step 44 and engages a step brace 56, discussed below with reference to FIGS. 4A & 4B, to facilitate pivotal operation of the step 44 when the step ladder 1 assumes the open and closed positions.

A step brace 56 (also shown in FIGS. 4A & 4B) is connected between the first front ladder leg 8 and the second front ladder leg 28, and adjacent to the front step portion 48 of the step 44. The step brace 56, among other things, provides stability and support for the step ladder 1. In the preferred embodiment, the step brace 56 has a brace pivot surface 57. The brace pivot surface 57 cooperatively engages the step recess 52 (shown in FIGS. 4A & 4B) to allow pivotal movement of the step 44 with respect to the step brace 56 and the first and second front legs 8 and 28 as the ladder travels from a closed to an open position. The progression of the pivotal movement of the step 44 can be readily discerned as the step ladder 1 takes on various positions from an open (shown in FIGS. 1 & 5) to a partially open (shown in FIG. 6) to a closed position (shown in FIG. 7).

The step ladder 1 further includes a rung 96 that may also be described by various sections. The rung is disposed below the step 44 and between the first and second front ladder legs 8 and 28. The rung 96 has a front rung portion 100, a first side rung portion 105 with a rung connector 112 and an identical opposing second side rung portion 106 with an opposing second rung connector 116 (partially shown). As is the case with the step 44, in the preferred embodiment, the rung 96 has a front rung portion 100 that has a rung recess portion 104 (similar to the step recess 52 and shown in FIGS. 4C & 4D). The rung recess portion 104 extends longitudinally across the front rung portion 100 of the rung 96 and engages a rung brace 108, discussed below with reference to FIGS. 4C & 4D, to facilitate the pivotal operation of the rung 96 when the step ladder 1 assumes the open and closed positions.

A rung brace 108 (also shown in FIGS. 4C & 4D) is connected between the first front ladder leg 8 and the second front ladder leg 28, and adjacent to the front rung portion 100 of the rung 96. The rung brace 108, among other things, also provides stability and support for the step ladder. In the preferred embodiment, the rung brace 108 has a rung pivot surface 109. The rung pivot surface 109 cooperatively engages the rung recess 104 to allow pivotal movement of the rung 96 with respect to the rung brace 108 and the first and second front legs 8 and 28. The progression of the pivotal movement of the rung 96 can also be discerned as the step ladder 1 takes on various positions from open (shown in FIG. 5) to partially open (shown in FIG. 6) to a closed position (shown in FIG. 7).

The step ladder 1 also has a pair of connecting members 88 and 92. The first connecting member 88 has two opposing ends 87 and 89 that will engage the first step connector 61 and the first rung connector 112 respectively. In the preferred embodiment, the second connecting member 92 has two identical opposing ends 91 and 93 that engage the second step connector 65 and second rung connector 116 respectively (partially shown). The connecting members 88 and 92 will translate the movement of the step 44 to the rung 96 thereby synchronizing or associating the movement of the step 44 and rung 96 as the step ladder 1 assumes various positions from an open to a closed position, as can be discerned from FIGS. 5–7. In the preferred embodiment, the opposing ends 87 & 89 and 91 & 93 of the respective connecting members 88 and 92, the step connectors 61 and 65, and the rung connectors 112 and 116 have flat flange-like configurations. Further, the connecting members 88 and 92 are riveted to the appropriate step and rung connectors 61, 65, 112 and 116. These configurations and connection are merely the preferred choice. They may take any form or manner that will allow for the rung 96 to move synchronously with the step 44, as will be readily appreciated by those skilled in the art.

FIG. 1 further shows leg footings 128A, B, C and D. Each ladder leg 8, 28, 12 and 32 has a corresponding leg footing 128A, B, C and D that stabilizes and secures the step ladder 1 in the open position. Any footing configuration or material that will maintain the step ladder 1 in a stable and secure open position may be used. Last, a pair of rear cross-braces 120 and 124 are also shown. The rear cross-braces 120 and 124 are disposed between the first rear leg 12 and the second rear leg 32 and provide additional stability and strength to the step ladder assembly 1. In the preferred embodiment, there are two rear cross-braces 120 and 124, however more or fewer rear cross-braces may be used.

Figure 2:
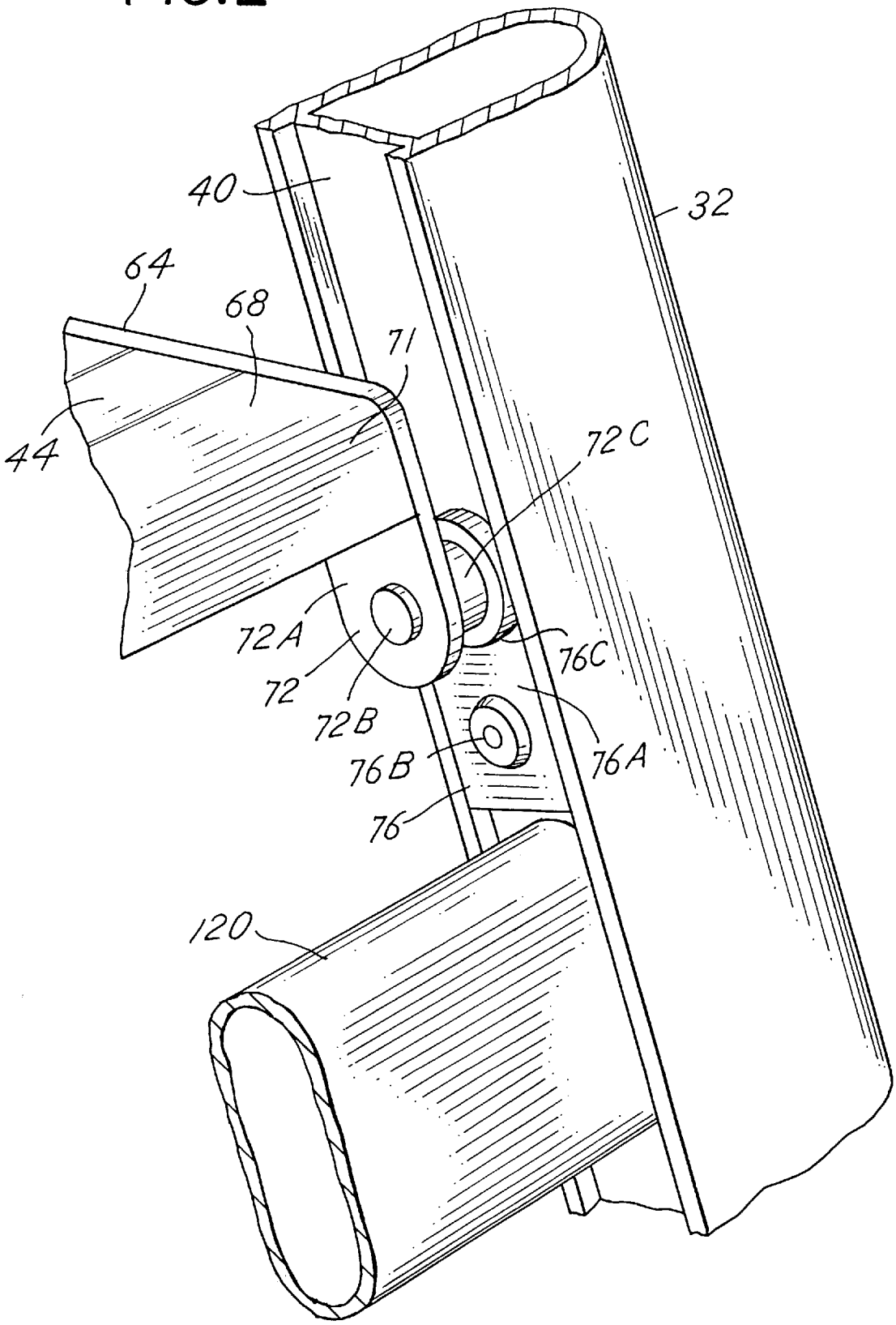
FIG. 2 is an isometric view showing in more detail the configuration of a second rear peg, a second channel guide and a second guide stopper in the ladder open position.

FIG. 2 shows an isometric view showing in more detail cut-away sections of the second rear leg 32, the second guide channel 40, the first rear cross-brace 120, the rear portion 68 of the step 44, one rear end portion 71 of the step 44, the second peg 72 and the second guide stopper 76. The components are shown in a step ladder open position. In the ladder open position (shown in FIG. 1) the step 44 has a substantially horizontal orientation and the second peg 72 engages the second guide stopper 76. The second guide stopper 76 provides weight bearing support for the step 44 and maintains the step in a substantially horizontal orientation in the step ladder open position.

In the preferred embodiment, the second peg 72 is comprised of a cylindrical section 72C riveted 72B to the rear end 72A of the second side section 64. However, the second peg 72 may be comprised of any number of different geometrically shaped components so long as the resultant peg 72 cooperatively engages the channel guide 40 to allow the step 44 to move between the open and closed positions. In the preferred embodiment, the guide stopper 76 is comprised of a flange-like substantially rectangular stopper piece 76A riveted 76B to the channel guide 40. The stopper piece 76A is located and configured in such a manner that the peg 72 will contact the top 76C of the stopper piece 76A and maintain the step in a substantially horizontal orientation. Again, however, the stopper piece 76A may be configured and located in any manner such that the step 44 will be oriented in a substantially horizontal position in the step ladder open position. Though not shown in detail to avoid redundancy, an identical configuration applies to the opposing first peg 80, first channel guide 20 and first guide stopper 84 (partially shown in FIG. 5) that interact with the first rear leg 12 (shown in FIG. 1). These components also cooperate to provide weight bearing support and maintain the step 44 in a substantially horizontal position in the step ladder open position.

Figure 3:
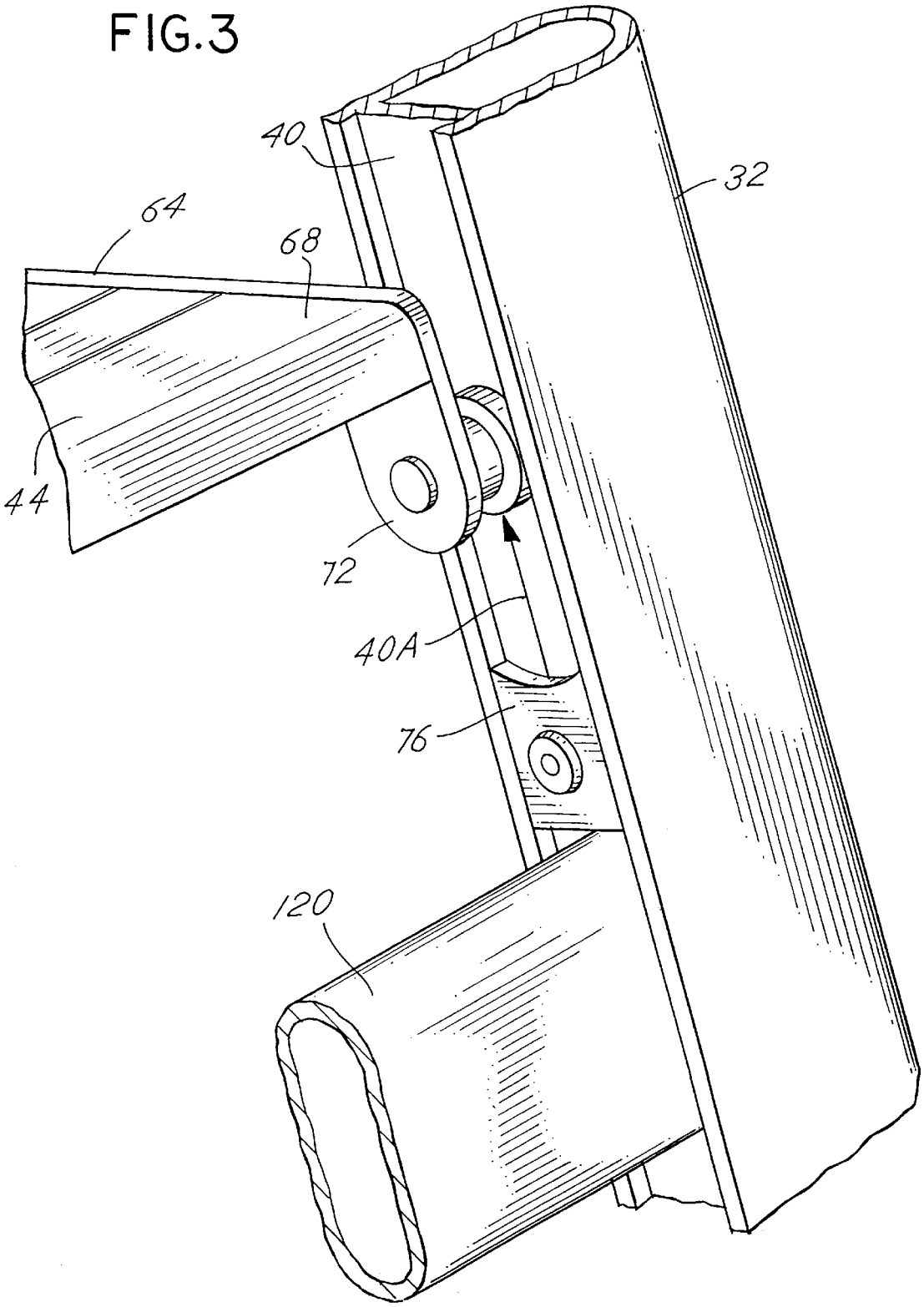
FIG. 3 is an isometric view showing the cooperation between the second rear peg and the second channel guide as the ladder travels from the open position to a closed position.

FIG. 3 shows an isometric view showing a cut-away section of the second rear leg 32, the second guide channel 40, the first rear cross-brace 120, the rear portion 68 of the step 44, the second peg 72 and the second guide stopper 76. However, the components in FIG. 3 are shown in a position where the step ladder is progressing from an open position to a closed position, as shown by an arrow indicator 40A. FIG. 3 clearly shows the cooperative engagement between the second peg 72 and the second channel guide 40 during operation of the ladder. In the preferred embodiment, the cylindrical second peg 72 slidably engages and travels in the second channel guide 40. As the step ladder is taken from the open position (shown in FIGS. 1 and 5) to the closed position (shown in FIG. 7) the second peg 72 travels in the second guide channel 40 from the second stopper 76 to near the top end 33 of the second rear leg 32 (shown in FIG. 7). Again, the second peg 72 and second channel guide 40 may be composed of any shape or configuration that allows their cooperative engagement as the step ladder operates between its open and closed positions. Moreover, though not shown to avoid redundancy, an identical configuration applies to the opposing first peg 80 and first channel guide 20 (partially shown in FIG. 5) that also cooperatively engage each other as the step ladder operates between its open and closed positions.

FIG. 4A shows a front view perspective showing the step 44, the ladder legs 8 and 28, and the step brace 56. The step 44 is shown in the ladder open position where the step 44 is in a substantially horizontal orientation. Also, partially shown is the front step portion 48, the step recess portion 52, the step brace 56 and the brace pivot surface 57 (more clearly shown in FIG. 4B). In the preferred embodiment, the step recess portion 52, the brace pivot surface 57 and the front ladder legs 8 and 28 cooperate to allow the step 44 to pivot as it assumes its ladder open and closed positions.

FIG. 4B shows a side view of the step ladder of FIG. 4A through the section line A—A showing in greater detail the step pivot connection 53 (also shown in FIG. 5) between the step 44 and the step brace 56. In the preferred embodiment, the step pivot connection 53 allows the step 44 to pivot relative to the step brace 56 and the front ladder legs 8 and 28. In particular, the front step portion 48 has a step recess portion 52 that cooperatively engages the brace pivot surface 57 of the step brace 56. Further, in the preferred embodiment, the step recess portion 52 has a cross-sectional shape 52A that substantially resembles the letter C, while the brace pivot surface 57 has an L cross-sectional curved shape 57A that complimentarily engages the step recess 52 as the step 44 pivots and assumes its ladder open and closed positions. As will be readily appreciated by those skilled in the art, the step pivot connection 53 may assume any configuration that allows the step 44 to pivot in assuming the ladder open and closed positions. Briefly for example, the step 44 and step brace 56 could be connected in a hinge type mechanism, or the step 44 could pivot entirely on pivot connections to the ladder legs 8 and 28 instead of pivotally interacting directly with the step brace 56.

FIG. 4C shows a front view perspective showing the rung 96, the ladder legs 8 and 28, and the rung brace 108. The rung 96 is shown in the ladder open position where the rung 96 is in a substantially horizontal orientation. Also, partially shown is the front rung portion 100, the rung recess portion 104, the rung brace 108 and the rung pivot surface 109 (more clearly shown in FIG. 4D). In the preferred embodiment, the rung recess portion 104, the rung pivot surface 109 and the front ladder legs 8 and 28 cooperate to allow the rung 96 to pivot as it assumes its ladder open and closed positions. In the preferred embodiment, the ladder rung 96 pivots in an identical manner as the step 44 (more clearly seen in FIGS. 5–7).

FIG. 4D shows a side view of the step ladder of FIG. 4C through the section line B—B showing in greater detail the rung pivot connection 107 (also shown in FIG. 5) that is identical in configuration to the step pivot connection 53 (shown in FIG. 4B) just discussed. In the preferred embodiment, the rung pivot connection 107 allows the rung 96 to pivot relative to the rung brace 108 and the front ladder legs 8 and 28. In particular, the front rung portion 100 has a rung recess portion 104 that cooperatively engages the rung pivot surface 109 of the rung brace 108. As was the case with the step 44, the rung recess portion 104 has a corresponding cross-sectional shape 104A that substantially resembles the letter C, while the rung pivot surface 109 has a corresponding L cross-sectional curved shape 109A that will complimentarily engage the rung recess 104 as the rung 96 pivots and assumes its ladder open and closed positions. Again, as will be appreciated by those skilled in the art, the rung pivot connection 107 may assume any configuration that allows the rung 96 to pivot in assuming the ladder open and closed positions. For example, the rung 96 and rung brace 108 could be connected in a hinge type mechanism, or the rung 96 could pivot entirely on pivot connections to the ladder legs 8 and 28 instead of pivotally interacting directly with the rung brace 108.

Figure 5:
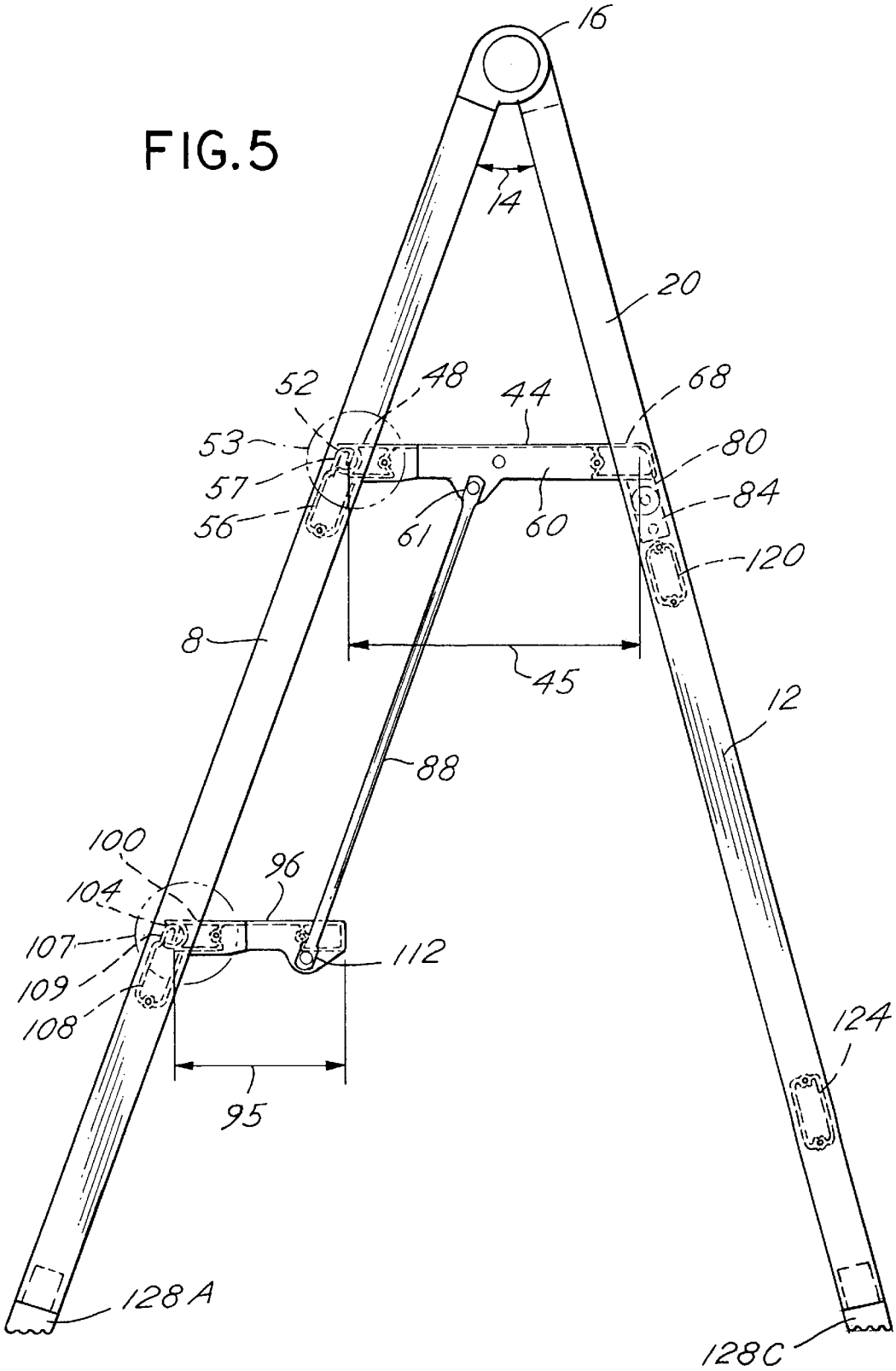
FIG. 5 is a side orthogonal view showing the collapsible step ladder in the open position.

FIG. 5 is a side view showing the collapsible step ladder in an open position. In the open position, the pivotally connected 16 first front and rear legs 8 and 12 form an acute first angle 14. A similar acute second angle 34 is formed by the pivotally connected 36 second front and rear legs 28 and 32 (shown in FIG. 1). The step 44 and the rung 96 are horizontal and substantially parallel to each other with the connecting members 88 and 92 (shown in FIG. 1) connected between them. The connecting members 88 and 92 engage both the step 44 and rung 96 at the corresponding step and rung connectors 61 & 112 and 65 & 116 (shown in FIG. 1), respectively. The connecting members 88 and 92 provide weight bearing support for the rung 96 and maintain the rung 96 in a substantially horizontal position with respect to the step 44. In addition, the connecting members 88 and 92 will translate movement of the step 44 to the rung 96. The connecting members 88 and 92 will therefore move the rung 96 in synchronous motion with the step 44, as the step ladder operates between the step ladder closed and open position when in use and back to closed position when not in use, as is discernable from FIGS. 5–7.

Furthermore, FIG. 5 shows the position of the first peg 80 in relation to the first guide stopper 84 and first channel guide 20 in the step ladder 1 open position. The first guide stopper 84 is disposed inside the first channel guide 20 and rests on the first guide stopper 84. In this position, the first peg 80 cooperates with the first guide stopper 84 and channel guide 20 to provide weight bearing support and maintain the step 44 in a substantially horizontal position. Though not shown, a similar configuration applies to the opposing second peg 72, the second channel guide stopper 76 and the second channel guide 40 (discussed with reference to FIGS. 2 & 3) that also cooperatively engage each other to provide weight bearing support and maintain the step 44 in a substantially horizontal position.

Figure 6:
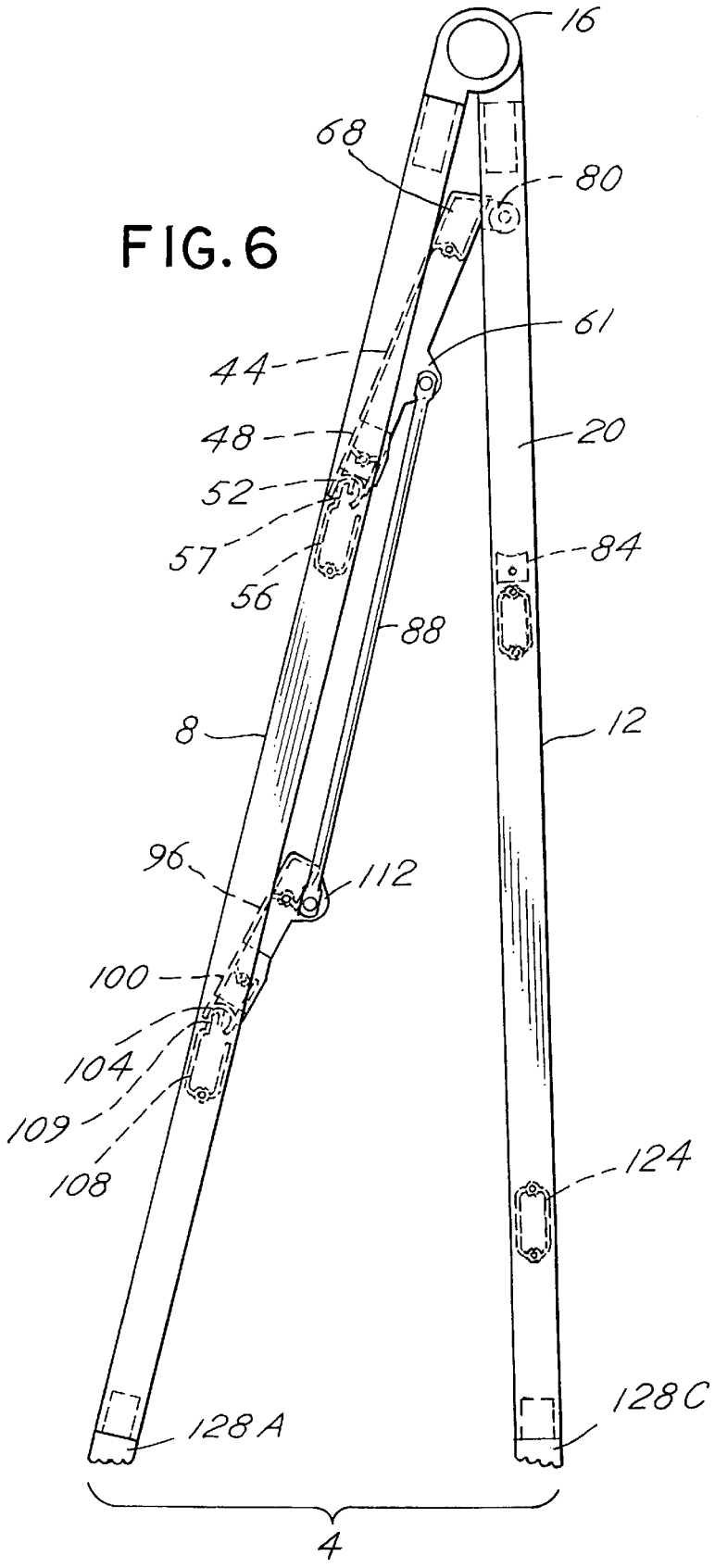
FIG. 6 is a side orthogonal view showing the collapsible step ladder in a position between the open and closed position.
Figure 7:
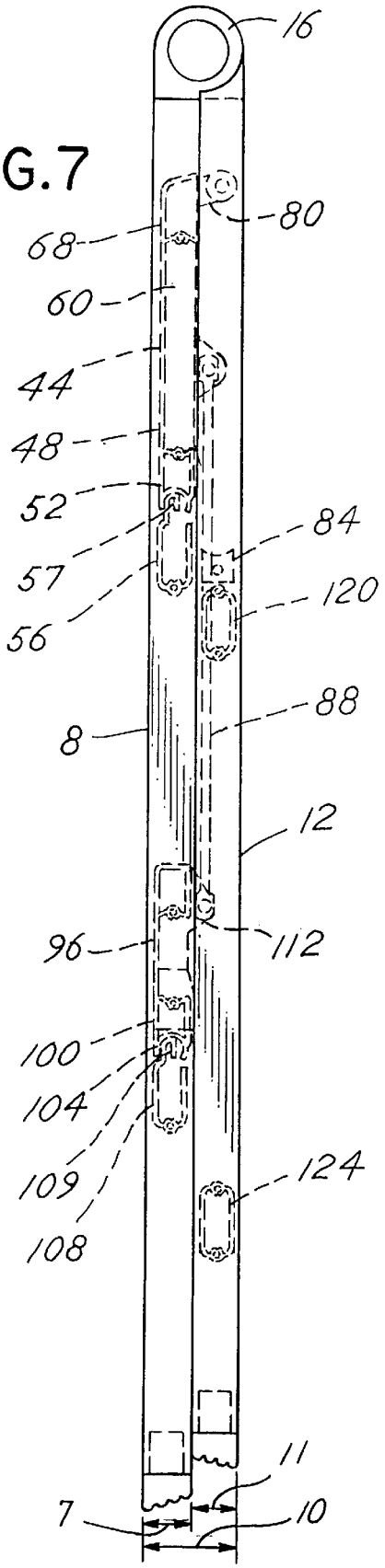
FIG. 7 is a side orthogonal view showing the collapsible step ladder in the closed position.

FIG. 6 is a side view showing the collapsible step ladder 1 in an alternate position between the open and closed positions, shown in FIGS. 5 and 7 respectively. This view more clearly shows the relationship and cooperation between the various components of the step ladder assembly, as the step ladder operates between the step ladder open and closed position. FIG. 6 shows the synchronous pivotal movement of the step 44 and rung 96 resulting from the connecting members 88 and 92 (shown in FIG. 1) connected between them. As the step ladder operates, the front step portion 48 pivots with respect to the step brace 56 and the front ladder legs 8 and 28. The pegs 80 and 72 (shown in FIGS. 1 & 3) extending from the rear step portion 68 cooperatively engage the respective first and second channel guides 20 and 40 (also shown in FIGS. 2 & 3) to allow the step 44 to easily move from a substantially horizontal orientation to a substantially vertical position in the step ladder closed position. In the preferred embodiment, the pegs 80 and 72 slidably engage their respective channel guides 20 and 40. This movement of the first and second pegs 80 and 72 "pulls" the rear ladder legs 12 and 32 toward the front ladder legs 8 and 28. It should be noted that any mechanical coupling configuration between the pegs 80 and 72 and the channels guides 20 and 40 may be used so long as the step 44 still pivots and the rear ladder legs 12 and 32 swing, either in or out, in response to motion of the step 44.

As the step 44 pivots, so too does the rung 96, that pivots with respect to the rung brace 108 and the front ladder legs 8 and 28. The synchronous movement of the rung 96 with the step 44 is accomplished through the connecting members 88 and 92 (shown in FIG. 1) that mechanically couple the rung 96 to the step 44 through the respective step and rung connectors 61 & 112 and 65 and 116. The connecting members 88 and 92 may take on any configuration or design that will carry out the synchronous movement of the step 44 and the rung 96 during operation of the step ladder 1.

FIG. 7 is a side view showing the collapsible step ladder in a closed position. In the closed position, all the step ladder components are disposed between the ladder legs 8, 12, 28 and 32. In the closed position, the ladder legs, 8, 12, 28, and 32, the step 44, the rung 96 and the connecting members 88 and 92 (shown in FIG. 1) are oriented in a substantially vertical position and are all adjacent and substantially parallel to each other, that results in a very advantageous feature of the invention, i.e., a slim and compact collapsible step ladder. In the closed position, the step ladder 1 has a collapsed ladder thickness or dimensional width 10 that is no greater that the combined thicknesses 7 and 11 of the first front and rear legs 8 and 12, or alternatively no greater than the combined thicknesses 27 and 31 of the second front and rear legs 28 and 32 (shown in FIG. 1). In the preferred embodiment, the collapsed ladder thickness is approximately 40.3 millimeters.

FIGS. 1 and 5–7 show that in the preferred embodiment, the various components of the step ladder 1 operate as result of the movement of the step 44. Starting from an open position (shown in FIGS. 1 & 5), the step 44, in cooperation with the step brace 56 and front pair of ladder legs 8 and 28, pivots about the step brace 56 in a counter clockwise direction. The rear portion 68 of the step 44 travels radially upward. The rear pegs 72 and 80, that extend from the rear portion 68 of the step 44 travel in the first and second channel guides 20 and 40 of the first and second rear ladder legs 12 and 32 respectively. As a result, the rear ladder legs 12 and 32 are forced to move inward by the first and second pegs 72 and 80 respectively. The inward movement of the rear ladder legs 12 and 32 is further facilitated through the pivotal connections 16 and 36 of the respective front ladder legs 8 and 28 and rear ladder legs 12 and 32. As the rear ladder legs 12 and 32 move inward, the step 44 pivots and the first and second pegs 72 and 80 slidably move upwards in their respective channel guides 20 and 40 towards the respective top ends 13 and 33 of the rear ladder legs 12 and 32. Simultaneously, the ladder rung 96 is synchronously moved by the step 44 through the connecting members 88 and 92. As the step 44 is pivoting in the counter clockwise direction, the step 44 "pulls" on the rung connectors 112 and 116. This "pulling" action forces the rung 96 to move. The rung 96 cooperates with the rung brace 108 and the front pair of ladder legs 8 and 28 to pivot about the rung brace 108. Thus, the "pulling" action of the connecting members 88 and 92 on the rung 96 forces the rung 96 to pivot and synchronously move with the step 44 until the step ladder 1 assumes a closed position (shown in FIG. 7). The progression of movement of the various components can be readily discerned as the step ladder 1 takes on various positions from an open (shown in FIGS. 1 & 5) to a partially open (shown in FIG. 6) to a closed position (shown in FIG. 7).

In the closed position, the overall thickness 10 of the step ladder 1 is no greater that the combined thicknesses 7 and 11 of the first front and rear legs 8 and 12 (shown in FIG. 1). This resultant feature gives the step ladder 1 the desired compactness that allows the step ladder to be used and stored in locations that have minimal storage space or facilities. These locations include, among others, space limited apartments or condominiums, dormitory rooms, kitchen pantries, closets, hallways, under stairways, sofas or beds, inside vehicle trunk and many others.

In the preferred embodiment for this invention, the pivot mechanism 17 and 37 and the ladder legs footing 128A, B, C & D are made of plastic material, while the remaining step ladder 1 components are made of an aluminum alloy composite material. However, other materials may be used to make up the step ladder 1 components, including wood, iron, ceramic composites, metallic alloys or any combination of these materials. Additionally, in the preferred embodiment, the ladder legs 8, 12, 28 and 32 have a substantially rectangular cross section. However, as will be appreciated by those skilled in the art, the ladder legs 8, 12, 28 and 32 may take on others cross-sectional shapes. For example, the legs may take on a square or circular cross-sectional configurations and still maintain the desired features of the present invention.

The preferred embodiment of the present invention may alternatively be described (referring to FIGS. 1, 5 & 7) as comprising a front leg pair 8 and 28 (shown in FIG. 1) and a rear leg pair 12 and 32. The rear leg pair 12 and 32 is pivotally connected 16 and 36 to the front leg pair 8 and 28. The pivotal connection 17 and 37 permits movement of the rear leg pair 12 and 32 in a collapsing direction from the open position, where the ends 9A and 29A of the front leg pairs 8 and 28 and the ends 13A and 33A of the rear leg pairs 12 and 32 are disposed in a distal relationship, and where said respective ends 9A & 13A and 29A & 33A are disposed in a proximal relationship in a closed position. The front leg pair 8 and 28 has a first maximum thickness 7 or 27 measured in the collapsing direction and the rear leg pair 12 and 32 has a second maximum thickness 11 or 31 measured in the collapsing direction. In the preferred embodiment, the thickness 7, 11, 28 and 32 of each ladder leg 8, 12, 28 and 32 respectively is the same. Thus, the first maximum thickness refers to the thickness 7 or 27 of one of the front ladder legs 8 and 28, but not both, since they have the same dimension. Also, the second maximum thickness refers to the thickness 11 or 31 of one of the rear ladder legs 12 and 32, but not both, since they have the same dimension.

The step ladder 1 has a step 44 that cooperates with the front leg pair 8 and 28 and has a step width 45 (shown in FIG. 5) that exceeds the first 7 or 27 and second 11 or 31 maximum thicknesses. The step ladder also has at least one rung 96 that cooperates with the front leg pair 8 and 28 and has a rung width 95 that exceeds the first 7 or 27 and second 11 or 31 maximum thicknesses. The step ladder includes a means for pivoting the step 44 and at least one rung 96 relative to the front leg pair 8 and 28 as the rear leg pair 12 and 32 is moved from the open position to the closed position. The step ladder, in the closed position, has a maximum overall thickness 10 (shown in FIG. 7), measured in the collapsing direction, that is less than the step width 45 of the step 44 or the rung width 95 of the at least one rung 96. Furthermore, the maximum overall thickness 10 of the ladder in the closed position does not substantially exceed the sum of the first maximum thickness 7 or 27 and the second maximum thickness 11 or 31. Additionally, the means for pivoting the step 44 and rung 96 may include a step pivot connection 53 (shown in FIG. 5) between the step 44 and a step brace 56 extending between the front leg pair 8 and 28, and a rung pivot connection 107 (shown in FIG. 5) between the rung 96 and a rung brace 108 extending between the front leg pair 8 and 28. The step pivot connection 53 also has a brace pivot surface 57 formed on the step brace 56 and a step recess 52 on the step 44, the step recess 52 being shaped complementarily to the brace pivot surface 57, and the rung pivot connection 107 also having a rung pivot surface 109 formed on the rung brace 108 and a rung recess 104 on the rung 96, where the rung recess 104 is shaped complementarily to the rung pivot surface 109.

Figure 8:
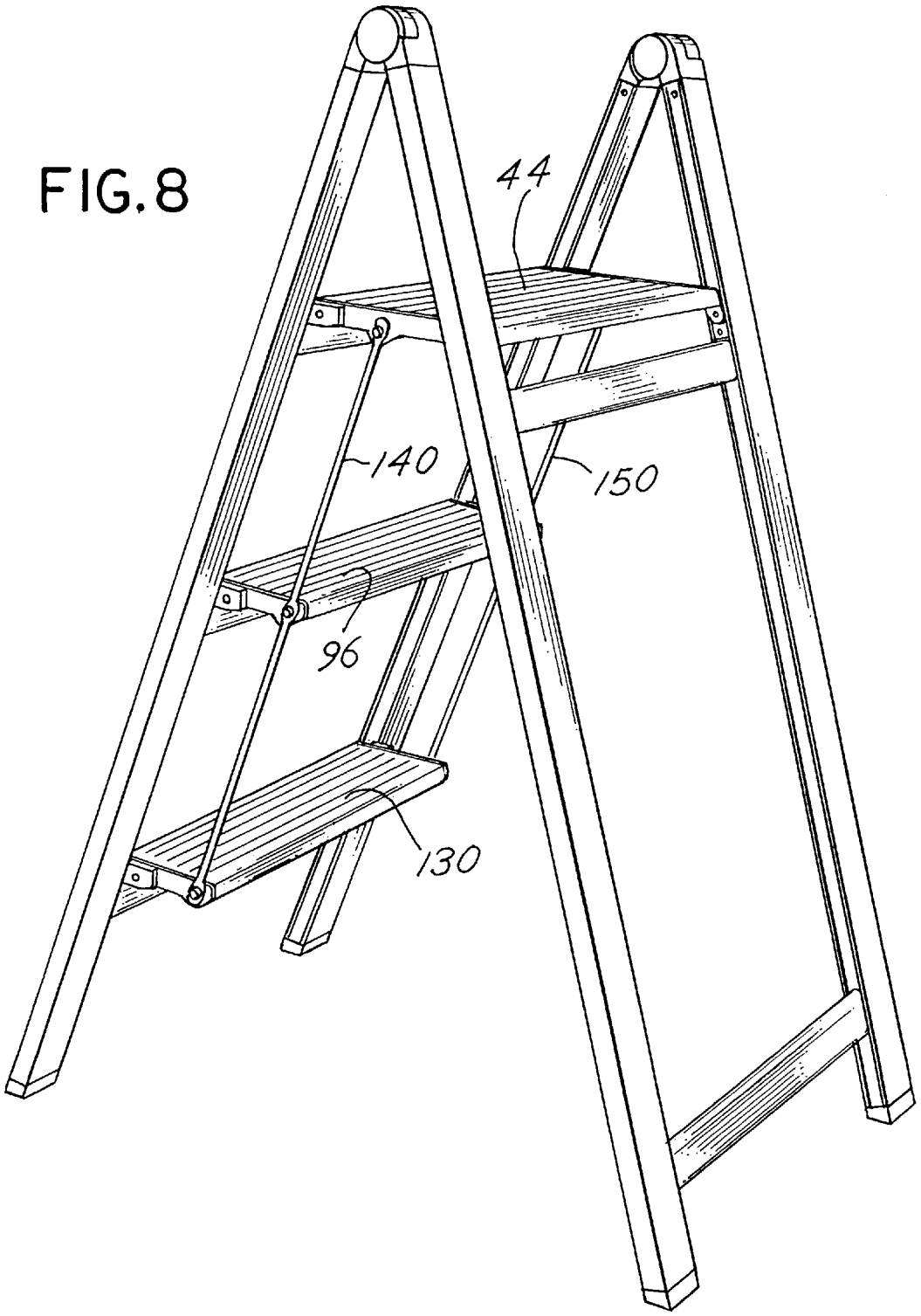
FIG. 8 is a perspective view showing a two rung embodiment of the collapsible step ladder in the open position.

The present invention has been described in considerable detail with reference to a preferred embodiment thereof, however, other versions are possible. For example, another version of the present invention would comprises an additional second rung 130 (FIG. 8), identical to the rung 96 of the preferred embodiment (shown in FIG. 1). In the two rung version of FIG. 8, the modified connecting members 140 and 150 are modified to couple the step 44 and two rungs 96 and 130. The modified connecting members 140 and 150 will translate the movement of the step 44 to the two rungs 96 and 130, thereby synchronizing or associating the movement of the step 44 and two rungs 96 and 130 as the step ladder assumes various positions from an open to a closed position, as was the case with the preferred version of this invention. The two rung version operates the same in all respects as described previously with reference to the preferred embodiment.

The preferred embodiment is exemplary and the invention is limited only by the following claims and equivalents thereof.

What is claimed is:

1. A compact collapsible step ladder operable between an open and a closed position comprising:

a first ladder support comprising a first front leg and a first rear leg, the first front and first rear legs each having a predetermined thickness;

a second ladder support comprising a second front let and a second rear leg, the second front and second rear legs each having a predetermined thickness;

a step adapted for pivotal movement with respect to the first and second front legs and disposed between said first ladder support and said second ladder support;

said step further comprises at first rear peg and an opposing second rear peg;

a front step portion;

a step brace extending between the front legs and cooperatively engaging the front step portion for pivotal movement of the step with respect to the first and second front legs;

said first rear leg further comprises a first channel guide and a first channel guide stopper such that the first rear peg, the first channel guide and the first guide stopper cooperate to maintain the step in a substantially horizontal orientation in the ladder open position, said second rear leg further comprises a second channel guide and a second channel guide stopper such that the second rear peg, the second channel guide and the second guide stopper cooperate to maintain the step in a substantially horizontal orientation in the ladder open position;

at least one rung adapted for pivotal movement with respect to the first and second front legs and disposed between said first ladder support and said second ladder support;

said at least one rung further comprises a front rung portion;

a rung brace extending between the front legs and cooperatively engaging the front rung portion for pivotal movement of the rung with respect to the first and second front legs; and at least one connecting member wherein the at least one connecting member, the step and the at least one rung are adapted to cooperate such that there is synchronous movement of the step and the at least one rung as the compact collapsible step ladder assumes the open and closed positions;

whereby the compact collapsible step ladder in the closed position has a collapsed ladder thickness that does not exceed the combined thickness of the first front and first rear legs.

2. The compact collapsible step ladder as recited in claim 1 wherein:

said first ladder support further comprises a first pivotal connection adapted to couple the first front and first rear leg such that the first front and first rear legs form a first acute angle in the open position; and said second ladder support further comprises a second pivotal connection adapted to couple the second front and second rear leg such that the second front and second rear legs form a second acute angle in the open position.

3. The compact collapsible step ladder as recited in claim 2 wherein:

said first rear peg slidably engages the first channel guide and rests on the first channel stopper in the ladder open position; and said second rear peg slidably engages the second channel guide and rests on the second channel stopper in the ladder open position.

4. The compact collapsible step ladder as recited in claim 3 wherein:

said step further comprises a first step connector and a second step connector;

said rung further comprises a first rung connector and a second rung connector; and a first and second connecting member;

whereby the first connecting member couples the first step connector to the first rung connector, and the second connecting member couples the second step connector to the second rung connector.

5. The compact collapsible step ladder as recited in claim 4 wherein:

said front step portion further comprises a step recess extending longitudinally along the front step portion;

a step brace pivot surface extending longitudinally along the step brace, the step brace pivot surface cooperatively engaging the step recess for pivotal movement of the step with respect to the first and second front legs;

said front rung portion further comprising a rung recess extending longitudinally along the front rung portion;

a rung pivot surface extending longitudinally along the rung brace, the rung pivot surface cooperatively engaging the rung recess for pivotal movement of the rung with respect to the first and second front legs.

6. The compact collapsible step ladder as recited in claim 5 wherein the pivotal connection is comprised of a hinged mechanism.

7. The compact collapsible step ladder as recited in claim 6 wherein the first front, first rear, second front and second rear legs each comprise a footing, the footing adapted to provide ladder stability in the open position.

8. The compact collapsible step ladder as recited in claim 7 further comprising at least one rear brace, the at least one rear brace extending between the first and second rear legs.

9. The compact collapsible step ladder as recited in claim 8 wherein the pivotal connection is comprised of a plastic material.

10. The compact collapsible step ladder as recited in claim 9 wherein the footing is comprised of plastic material.

11. The compact collapsible step ladder as recited in claim 10 wherein the first front, first rear, second front and second rear legs each comprise a substantially rectangular cross section.

12. The compact collapsible step ladder as recited in claim 11 further comprising a second rung adapted for pivotal movement with respect to the first and second front legs and disposed between said first ladder support and said second ladder support, the second rung having a third rung connector and a fourth rung connector;

wherein the first connecting member couples the first step connector to the first rung connector and the third rung connector, and the second connecting member couples the second step connector to the second rung connector and the fourth rung connector.

13. A compact collapsible step ladder operable between an open and a closed position comprising:

a first ladder support comprising a first front and a first rear leg, each leg having a predetermined thickness, the first rear ladder leg further comprising a first channel guide and a first guide stopper;

a second ladder support comprising a second front and a second rear leg, each leg having a predetermined thickness, the second rear ladder leg further comprising a second channel guide and a second guide stopper;

a step adapted for pivotal movement with respect to the front ladder legs;

said step first comprising a first step connector, a second step connector;

a front step portion, and a step brace extending between the front legs and cooperatively engaging the front step portion for pivotal movement of the step with respect to the first and second front legs;

a first peg and a second peg;

said first peg cooperatively engaging the first channel guide and the first guide stopper to maintain the step in a substantially horizontal orientation in the ladder open position, said second peg cooperatively engaging the second channel guide and the second guide stopper to maintain the step in a substantially horizontal orientation in the ladder open position;

at least one ladder rung adapted for pivotal movement with respect to the front ladder legs and comprising a first rung connector and a second rung connector;

said at least one, rung further comprises a front rung portion, and a rung brace extending between the front legs and cooperatively engaging the front rung portion for pivotal movement of the rung with respect to the first and second front legs; and a first and a second coupler member, the first coupler member coupling the first step connector to the first rung connector, the second coupler member coupling the second step connector to the second rung connector such that the first and second coupler members synchronize the movement of the ladder rung with the stop as the ladder assumes the open and closed positions;

whereby the compact collapsible step ladder in the closed position has a collapsed ladder thickness that does not exceed the combined thickness of the front and rear ladder legs.

14. A compact collapsible step ladder operable between an open and a closed position comprising:

a front leg pair;

a rear leg pair pivotally connected to the front leg pair to permit movement of the rear leg pair in a collapsing direction from an open position wherein respective ends of the front and rear leg pairs are disposed in a distal relationship, and where said respective ends are disposed in a proximal relationship in a closed position;

said front leg pair having a first maximum thickness measured in the collapsing direction and the rear leg pair having a second maximum thickness measured in the collapsing direction;

a step cooperating with the front leg pair and having a width that exceeds the first and second maximum thicknesses;

said step further comprises a first rear peg and an opposing second rear peg;

said rear leg pair further comprises a first rear leg and a second rear leg wherein the first rear leg further comprises a first channel guide and a first channel guide stopper such that the first rear peg, the first channel guide and the first guide stopper cooperate to maintain the step in a substantially horizontal orientation in the ladder open position, and the second rear leg further comprises a second channel guide and a second channel guide stopper such that the second rear peg, the second channel guide and the second guide stopper cooperate to maintain the step in a substantially horizontal orientation in the ladder open position;

said first rear peg slidably engages the first channel guide and rests on the first channel guide stopper in the ladder open position; and said second rear peg slidably engages the second channel guide and rests on the second channel guide stopper in the ladder open position;

at least one rung cooperating with the front leg pair and having a width that exceeds the first and second maximum thicknesses;

a pivoting assembly for pivoting the step and at least one rung relative to the front leg pair as the rear leg pair is moved from the open position to the closed position;

said pivoting assembly for pivoting further comprises a step pivot connection between the step and a step brace extending between the front leg pair, and a rung pivot connection between the at least one rung and a rung brace extending between the front leg pair;

said step pivot connection further comprises a step brace pivot surface formed on the step brace and a step recess on the step, the step recess shaped complementarily to the step pivot surface;

said rung pivot connection further comprises a rung brace pivot surface formed on the rung brace and a rung recess on the rung, said rung recess shaped complementarily to the rung brace pivot surface; and at least one connecting member wherein the at least one connecting member, the step and the at least one rung are adapted to cooperate such that there is synchronous movement of the step and the at least one rung as the compact collapsible step ladder assumes the open and closed positions;

wherein the ladder, when in the closed position, has a maximum overall thickness, measured in the collapsing direction, that is less than the width of the step or at least one rung, and the maximum overall thickness does not substantially exceed the sum of the first and second maximum thickness.

15. The compact collapsible step ladder as recited in claim 14 wherein:

said step further comprises a first and second step connector;

said rung further comprises a first and second rung connector; and a first and second connecting member;

whereby the first connecting member couples the first step connector to the first rung connector, and the second connecting member couples the second step connector to the second rung connector.

16. The compact collapsible step ladder as recited in claim 15 wherein the pivotal connection between the front leg pair and the rear leg pair is comprised of a hinged mechanism.

17. The compact collapsible step ladder as recited in claim 16 wherein the front leg pair and rear leg pair each comprise a footing on each leg, the footing adapted to provide ladder stability in the open position.

18. The compact collapsible step ladder as recited in claim 17 further comprising at least one rear brace, the at least one rear brace extending between the first and second rear legs.

19. The compact collapsible step ladder as recited in claim 18 wherein the pivotal connection is comprised of a plastic material.

20. The compact collapsible step ladder as recited in claim 19 wherein the footing is comprised of plastic material.

21. The compact collapsible step ladder as recited in claim 20 wherein the first front, first rear, second front and second rear legs each comprise a substantially rectangular cross section.

22. The compact collapsible step ladder as recited in claim 20 further comprising a second rung cooperating with the front leg pair and having a width that exceeds the first and second maximum thicknesses, the second rung having a third rung connector and a fourth rung connector;

wherein the first connecting member couples the first step connector to the first rung connector and the third rung connector, and the second connecting member couples the second step connector to the second rung connector and the fourth rung connector.

23. A compact collapsible step ladder operable between an open and a closed position comprising:

a first ladder support having a first front leg and a first rear leg;

a second ladder support having a second front leg and a second rear leg;

a step adapted for pivotal movement with respect to the first and second front legs and disposed between the first ladder support and the second ladder support;

a first rear peg and an opposing second rear peg on the step respectfully positioned near the first rear leg and the second rear leg;

a first channel guide and a first channel guide stopper for engaging the first rear peg to maintain the step in a substantially horizontal or limitation when the ladder is in an open position;

a second channel guide and a second channel guide stopper for engaging the second rear peg to maintain the step in a substantially horizontal orientation when the ladder is in an open position;

a step brace extending between the front legs and cooperatively engaging the step for pivotal movement of the step with respect to the first and second front legs;

at least one rung adapted for pivotal movement with respect to the first and second front legs and disposed between said first ladder support and said second ladder support;

a connecting member adapted to cooperate with the step and the at least one rung to provide synchronous movement of the step and the at least one rung as the compact collapsible step ladder assumes the open and closed positions; and a rung brace extending between the front legs and cooperatively engaging the rung for pivotal movement of the rung with respect to the first and second front legs whereby the collapsible ladder can assume an open or closed position.

* * * * *